United States Patent [19]

Chen

[11] Patent Number: 4,885,972

[45] Date of Patent: Dec. 12, 1989

[54] TOY XYLOPHONE

[76] Inventor: Chen-Tsung Chen, No. 16 Alley 2, Fengyuan, Taiwan

[21] Appl. No.: 191,990

[22] Filed: May 9, 1988

[51] Int. Cl.[4] ..... G10D 13/08
[52] U.S. Cl. ..... 84/403
[58] Field of Search ..... 84/403, 404, 405

[56] References Cited

U.S. PATENT DOCUMENTS 2,215,358 9/1940 Konikoff ..... 84/403
2,317,164 4/1943 Zimmerman ..... 84/403

FOREIGN PATENT DOCUMENTS 6510500 2/1967 Netherlands ..... 84/403

*Primary Examiner*—L. T. Hix
*Assistant Examiner*—Brian W. Brown
*Attorney, Agent, or Firm*—Fleit, Jacobson, Cohn, Price, Holman & Stern

[57] ABSTRACT

A xylophone includes two horizontally spaced and facing supporters each of which includes a top plate, a back plate, a bottom plate and two ends all of which define thereamong a receiving room, a plurality of parallel note-producing pipes respectively having two ends thereof received in the receiving rooms, and two connectors each of which detachably connects one of two ends of each supporter.

5 Claims, 6 Drawing Sheets

TOY XYLOPHONE

BACKGROUND OF THE INVENTION

The present invention relates to a xylophone, and more particularly to a toy xylophone.

Conventionally, a toy xylophone includes a trapezoid wood frame riveting thereon a predetermined number of parallelly arranged metal plates of different lengths for playing a song when the metal plates are suitably beaten in sequence by a beater. Such xylophone suffers from the following disadvantages that the riveting work is cumbersome and that the metal plates must be made of the expensive steel.

In an effort to overcoming the above shortcomings, it has been proposed that the two horizontally spaced supports of the trapezoid positioning frame should each include a plurality of arcuate grooves having the surfaces thereon attached to a cushioning member for supporting thereon respective ends of metal note-producing pipes of different lengths. While such xylophone achieves the effect that the pipes can be made of the cheap aluminum alloy to obtain notes of a good tonality, it suffers from the fact that the pipes cannot be secured to the positioning frame so that it cannot be optionally moved after assembled in order to prevent the pipes from escaping from the arcuate grooves.

In an attempt to obviate the shortcoming encountered by the preceding xylophone(s), it was proposed that the ends of the pipes are radially holed so that a wire and a positioning button can securely fix the pipes on the positioning frame. Nevertheless, the holing procedure and the procedure of threading the wire in the end holes of the pipes are troublesome and time-consuming.

In addition to the shortcomings separately described above, all the prior xylophones commonly have the following disadvantages:

1. The positioning frame is integrally formed so the it is relatively large and inconvenient both in packaging and in carrying. The inconvenience will become more apparent if the scale or the number of the pipes is expanded.

2. The note produced by the pipe is solely determined by the length thereof. Theoretically, the length of a pipe having constant diameter and wall thickness can be set to produce notes in a full scale, however, in practice, a pipe having constant diameter and wall thickness can only produce accurate notes in a predetermined range of the music scale. In other words, if a xylophone can produce accurate notes of higher frequencies, it will be incapable of accurately producing notes of relatively lower frequencies. This phenomenon will be more evident if the number of the pipes used is increased.

It is therefore attempted by the Applicant to deal with the situation described above.

SUMMARY OF THE INVENTION

It is therefore an object of the present invention to provide a xylophone in which the note-producing pipes can be supported in the positioning frame (supporting means) in a simple and secure manner.

It is further an object of the present invention to provide a xylophone having the supporting means thereof capable of being detached.

It is additional an object of the present invention to provide a xylophone capable of accurately producing notes and having note producing pipes thereof capable of being telescoped together.

According to the present invention, a xylophone includes two horizontally spaced and facing supporters each of which includes a top plate, a back plate, a bottom plate and two ends all of which define thereamong a receiving room, a plurality of parallel note-producing pipes respectively having two ends thereof received in the receiving rooms, and two connectors each of which detachably connects one of two ends of each supporter.

Preferably the pipes have different diameters in a manner that the pipe producing a lower frequency can receive therein the pipe producing a relatively higher frequency.

The present invention may best be understood through the following description with reference to the accompanying drawings, in which:

DETAILED DESCRIPTION OF THE PREFERRED EMBODIMENT

Figure 1:
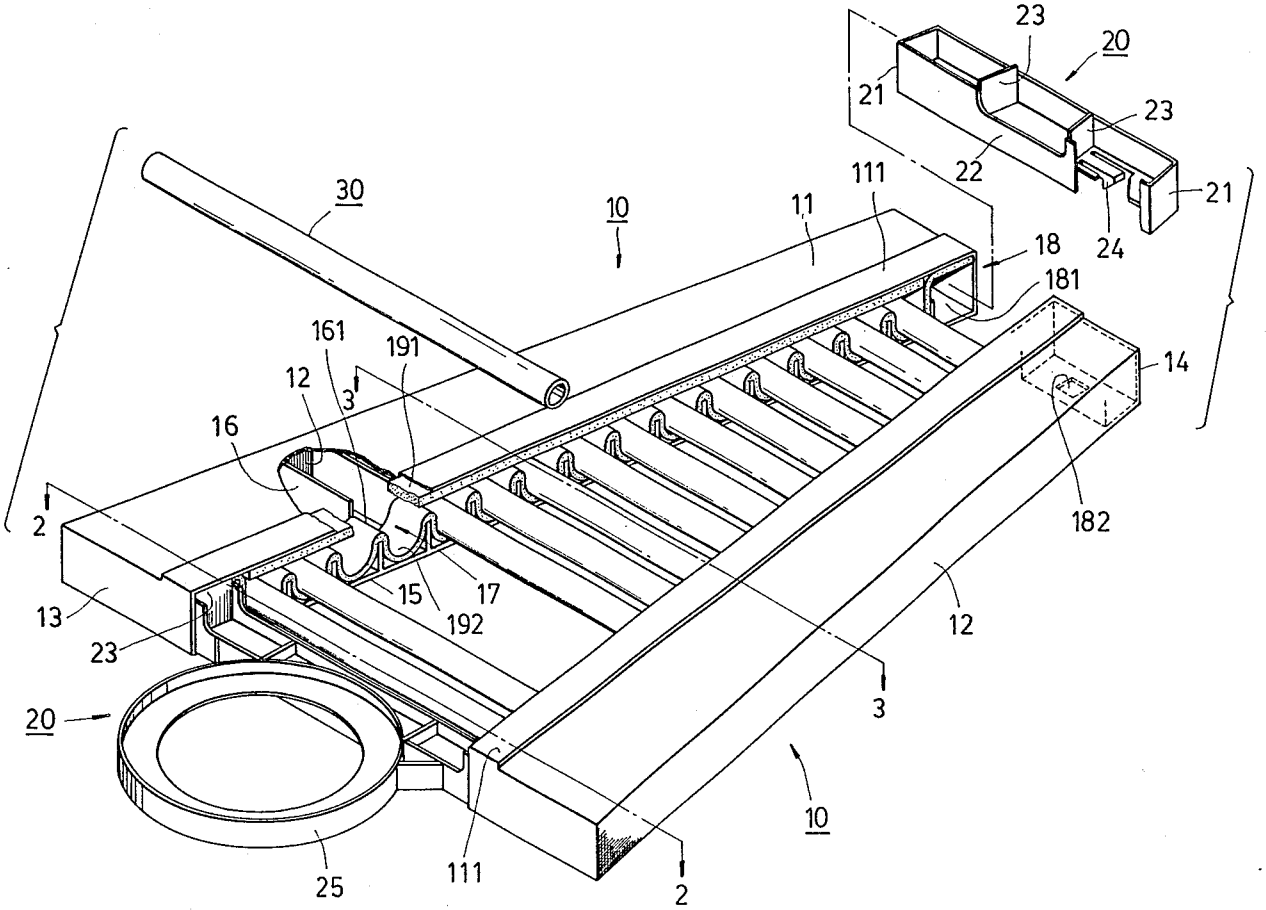
FIG. 1 is a perspective view showing a first preferred embodiment of a xylophone according to the present invention.
Figure 2:
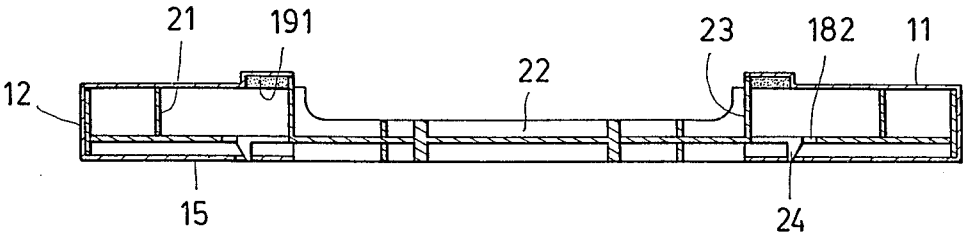
FIG. 2 is a sectional view taken along line 2—2 in FIG. 1.
Figure 3:
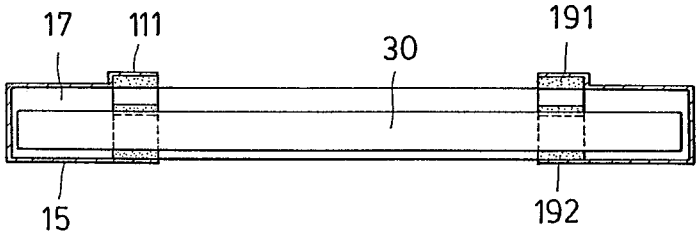
FIG. 3 is a sectional view taken along line 3—3 in FIG. 1.
Figure 4:
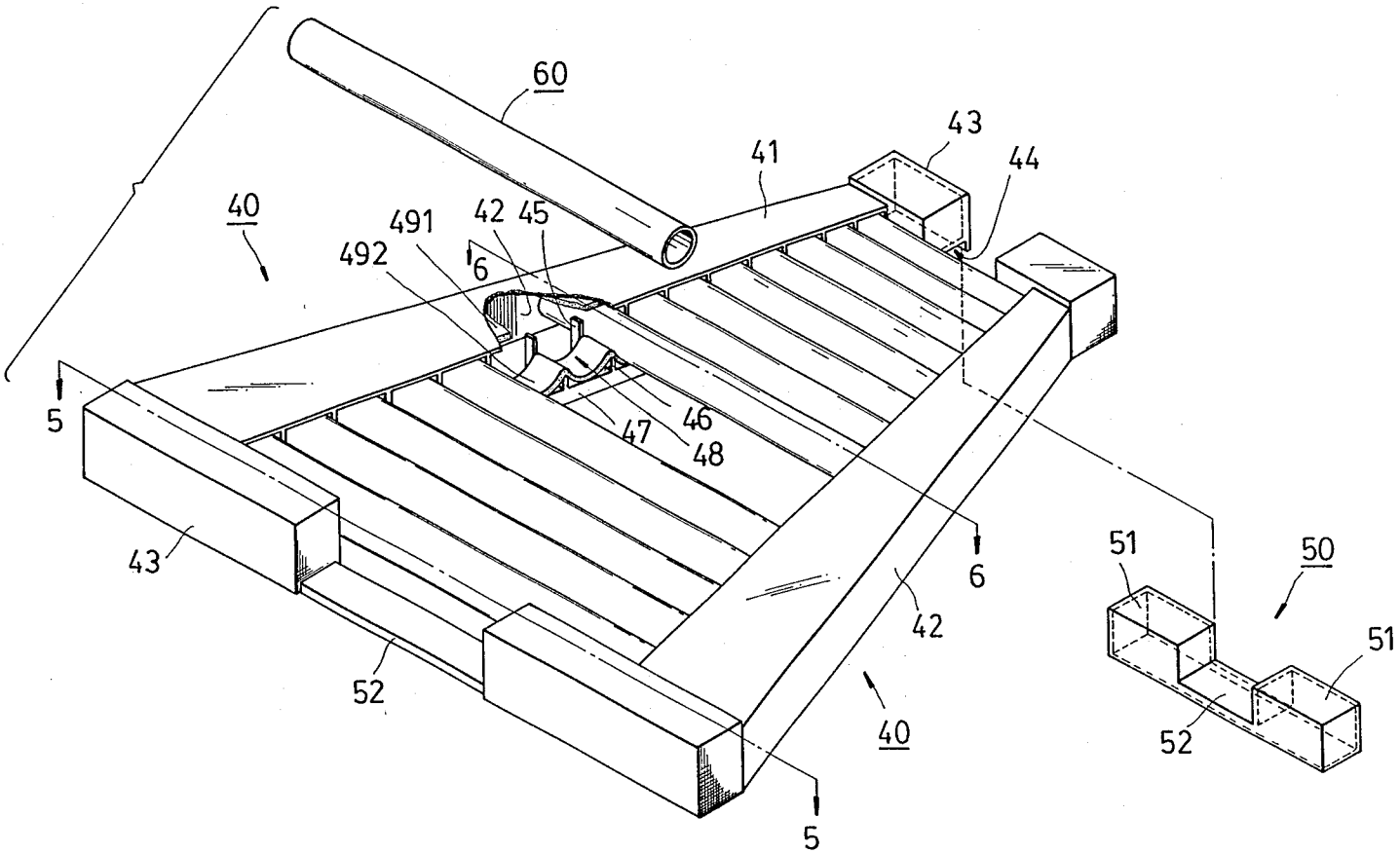
FIG. 4 is a perspective view showing a second preferred embodiment of a xylophone according to the present invention.
Figure 5:
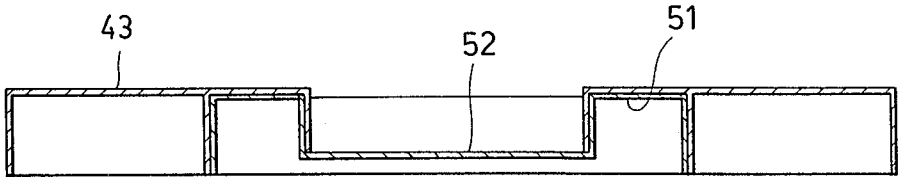
FIG. 5 is a sectional view taken along line 5—5 in FIG. 4.
Figure 6:
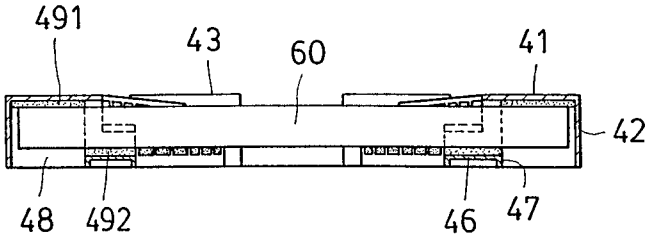
FIG. 6 is a sectional view taken along line 6—6 in FIG. 4.

Referring now to FIGS. 1-3, a first preferred embodiment of the present xylophone includes a supporting means having two horizontally spaced and facing supporters 10 and two connectors 20, and a plurality of parallel note producing pipes 30. Each supporter 10 includes a top plate 11 having a raised portion 111, a back plate 12, a bottom plate 15 and two ends 18 all of which define thereamong a receiving room or space which is divided into a plurality of regions 17 for respectively receiving therein one of two ends of each pipe 30 by a pluraity of partitions 16 each of which extends to contact with top, back and bottom plates 11, 12 & 15 but has a front upper cut 161 for passing therethrough a cushioning medium 192 which is thus wave-shapedly attached to bottom plate 15 and is a part of a cushioning means further including a cushioning medium 191 attached to and beneath raised portion 111. Each end 18 is constituted by top plate 11, back plate 12, bottom plate 15, the outermost partition 16 and a side plate 13 (14), and includes a connecting room 181 having a bottom holes 182. One of connectors 20 includes an annular handle 25 and each connector 20 includes two stopping plates 23 defining a central portion 22 and two connecting ends 21 each of which is capable of being suitably tightly received in connecting room 181 and includes a bottom flexible hook 24 engagable in bottom hole 182 when the respective connecting end 21 is inserted into the respective connecting room 181 with the respective stopping plate 23 contacting against the upper wall (11) of the respective connecting room 181. Pipes 30 are made of the aluminum alloy and are kept from directly contacting with the supporting means (10, 20) by the cushioning means (191, 192).

The described xylophone can be assembled in the manner as follows:

After connectors 20 have one ends 21 thereof inserted into connecting rooms 181 of a supporter 10, one ends of pipes 30 are inserted into regions 17 of the supporter 10. Then, after connecting rooms 181 and regions 17 of another supporter 10 are respectively aligned with another ends 21 of connectors 20 and another ends of pipes 30, two supporters 10 are pressed toward with each other.

If the xylophone is to be disassembled, respective flexible hooks 24 of connectors 20 are pushed to disengage from respective bottom holes 182 and thus the respective supporters 10 can be disengaged from connectors 20 which can further disengage from another supporter 10 which can now disengage therefrom pipes 30.

Figure 7:
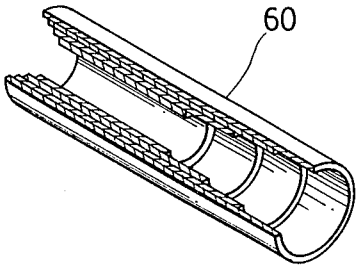
FIG. 7 is a schematic view showing the note producing pipes telescoped together.

As shown in FIGS. 4–7, a second preferred embodiment of the present xylophone includes two supporters 40, two connectors 50 and a plurality of parallel note producing pipes 60. Each supporter 40 includes a top plate 41, a back plate 42, a bottom plate 46 and two ends 43 all of which define thereamong a receiving room which is divided into a plurality of regions 48 by a plurality of L-shaped partitions 45 secured on bottom plate 46 which includes two leg ribs 47 and does not have a width capable of contacting with back plate 42. Each end 43 has a downwardly oriented connecting room 44. The bottom of top plate 41 is attached to a cushioning member 491 and the top of bottom plate 46 adheres thereon a wave-shaped cushioning member 492. Each connector 50 includes a central portion 52 and two connecting ends 51 each of which is capable of being suitably tightly received in the respective connecting room 44 in order that supporters 40 and connectors 50 can cooperatively constitute a supporting means for pipes 60. Pipes 60 can be made of the aluminum alloy and have different diameters, lengths and wall thickness in a manner that the pipe 60 producing a higher frequency can be received in the pipe 60 producing a relatively lower frequency. It is well-known that a pipe having a larger length, diameter or wall thickness, if beaten, will produce a note of lower frequency and a pipe having a smaller length, diameter or wall thickness, if beaten, will produce a note of higher frequency. With the length, the diameter and the wall thickness of the pipe acting as three designing parameters, the beaten pipes 60 can produce accurate notes of a high tonality and thus the problem encountered in the prior art that the xylophone can only accurate produce notes within a predetermined range in a music scale and will produce spurious notes beyond the range is overcome. As shown in FIG. 7, pipes 60 of different diameters achieve a further object that they can be telescoped together.

Such xylophone can be assembled in the manner that before connecting ends 51 are inserted into connecting rooms 44, respective two ends of pipes 60 are inserted into respective regions 48 of two supporters 40.

Figure 9:
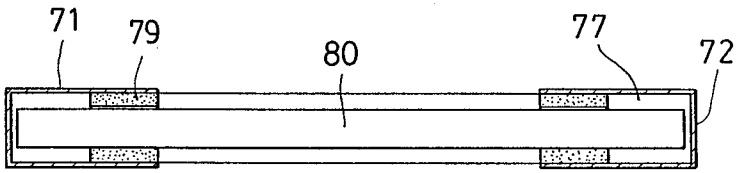
FIG. 9 is a sectional view taken along line 9—9 in FIG. 8.
Figure 8:
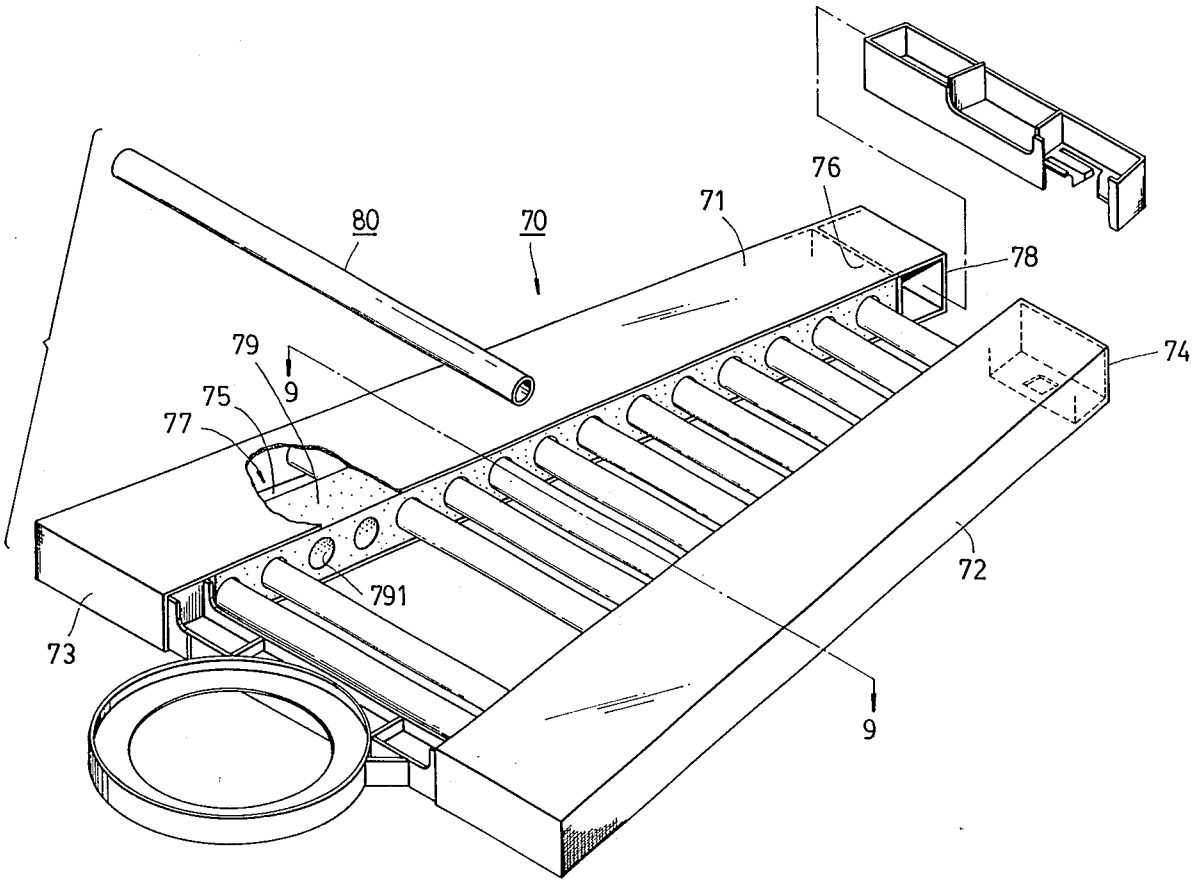
FIG. 8 is a perspective view showing a third preferred embodiment of a xylophone according to the present invention.

As shown in FIGS. 8 & 9, a third preferred embodiment of the present xylophone includes two supporters 70, and two connectors and multiple note producing pipes 80 as shown in FIGS. 1–3. Each supporter 70 include a top plate 71, a back plate 72, a bottom plate 75 and two ends 78 all of which define thereamong a receiving room 77 which includes therein a cushioning member 79, e.g. a sponge, having a plurality of through holes 791 for respectively receiving therein one ends of pipes 80. Each end 78 is constituted by top plate 71, back plate 72, bottom plate 75, a partition 76 and a side plate 73 (74).

Through the above description, it should now become readily apparent why and how the present invention can achieve its contemplated objects.

What I claim is:

1. A xylophone comprising two horizontally spaced elongate supporters each of which includes a receiving space and two ends, a plurality of parallel note-producing pipes respectively having two ends thereof received in said receiving spaces, and two connectors each of which detachably connects one of said two ends of each supporter wherein each said supporter further includes a top plate, a back plate and bottom plate all of which together with said two ends of each said supporter define said receiving space and wherein said receiving space is divided into a plurality of regions for respectively receiving therein one of said two ends of each said pipe by a plurality of partitions, and the bottom of said top plate and the top of said bottom plate are respectively attached to a cushioning medium.

2. A xylophone as claimed in claim 1 wherein said bottom plate does not contact with said back plate, and said partitions are L-shaped pieces secured on said bottom plate.

3. A xylophone as claimed in claim 1 wherein each of said partitions extends to contact with said top, back and bottom plates but has a front cut for passing therethrough said cushioning medium attached to said bottom plate.

4. A xylophone as claimed in claim 3 wherein each of said two ends of said each supporter includes a bottom hole and each of said connectors has two ends each of which has a bottom flexible hook engagable with said bottom hole.

5. A xylophone as claimed in claim 4 wherein one of said two connectors includes an annular handle.

* * * * *